United States Patent [19]

Pilkington

[11] 4,310,980

[45] Jan. 19, 1982

[54] QUICK DETACHABLE SCOPE MOUNT

[76] Inventor: Phillip Pilkington, P.O. Box 2284, Enid, Okla. 73701

[21] Appl. No.: 95,650

[22] Filed: Nov. 19, 1979

[51] Int. Cl.[3] ..... F41G 1/38

[52] U.S. Cl. ..... 42/1 ST; 33/250

[58] Field of Search ..... 42/1 ST; 33/250, 245, 33/247–249

[56] References Cited

U.S. PATENT DOCUMENTS

| | | | |
|---|---|---|---|
| 1,837,290 | 12/1931 | Redfield | 33/247 |
| 2,187,054 | 1/1940 | Redfield | 33/247 |
| 2,306,972 | 12/1942 | Meisel | 42/1 ST |
| 2,486,002 | 10/1949 | Buehler | 33/247 |
| 3,785,603 | 1/1974 | Apel | 33/247 |
| 4,249,315 | 2/1981 | Hopson | 42/1 ST |

FOREIGN PATENT DOCUMENTS

| | | | |
|---|---|---|---|
| 266848 | 3/1927 | United Kingdom | 33/250 |

OTHER PUBLICATIONS

*American Rifleman;* "Pilkington QD Conversion", p. 61, Aug. 1980.

*Primary Examiner*—Charles T. Jordan
*Attorney, Agent, or Firm*—Jack N. Shears

[57] ABSTRACT

A quick detachable improvement upon scope mount systems having a front mount allowing swiveling in the horizontal plane is disclosed. The rear mount and base of such scope mount systems are modified. The concavoid inner surfaces of the latching means mate with the convexoid surface machined into the same side of the bottom portion of the rear mount around a bore traversing horizontally through the upper portion of the base when the rear mount is positioned into the zeroed position, the bore being positioned below where the upper flat surface of the base abuts the flat surface of the rear scope mount. The second latching member of the improvement is truncated on a plane parallel to the bore through the base, and preferably has a lever means integral therewith such as to permit quick release of the rear mount and detachment of the scope by swinging out so as to detach the front mount. The improvement is applicable to a number of popular scope mount systems on the market.

11 Claims, 13 Drawing Figures

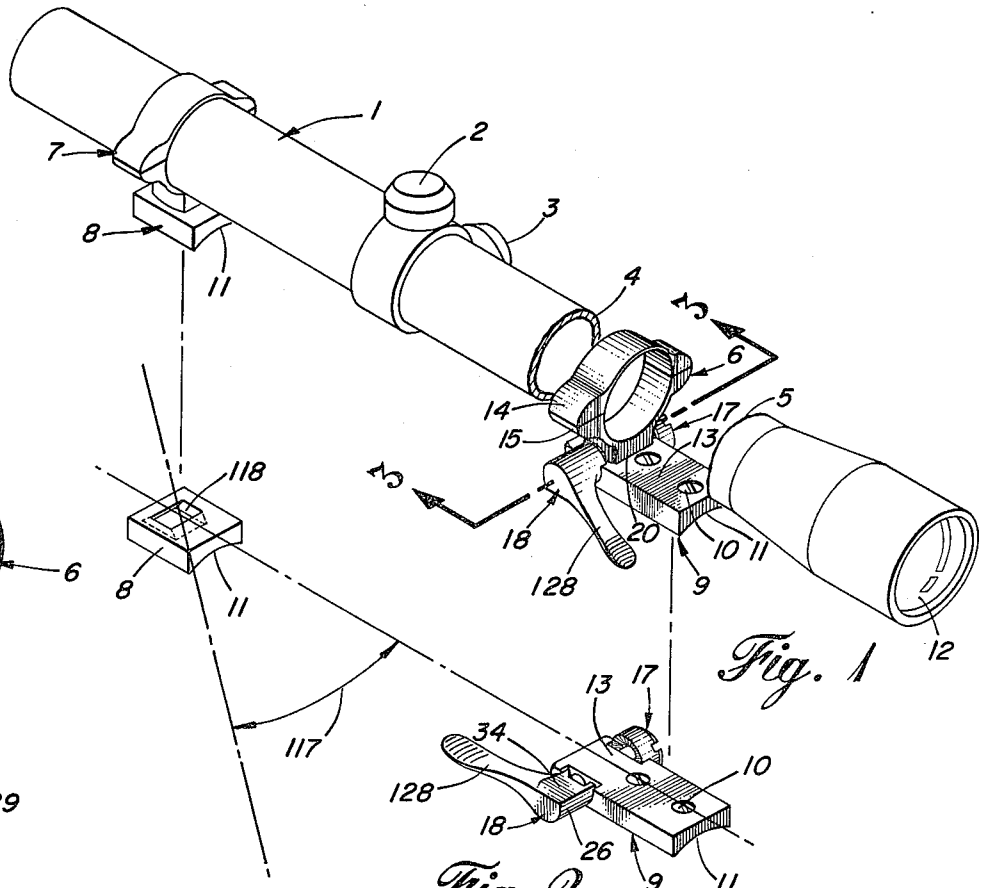
Fig. 1
Fig. 2
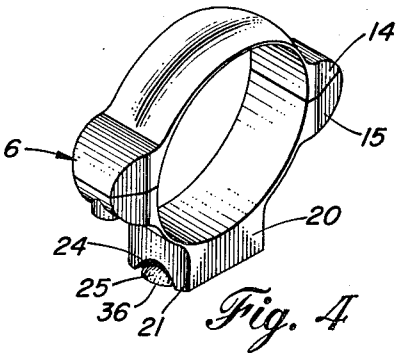
Fig. 4
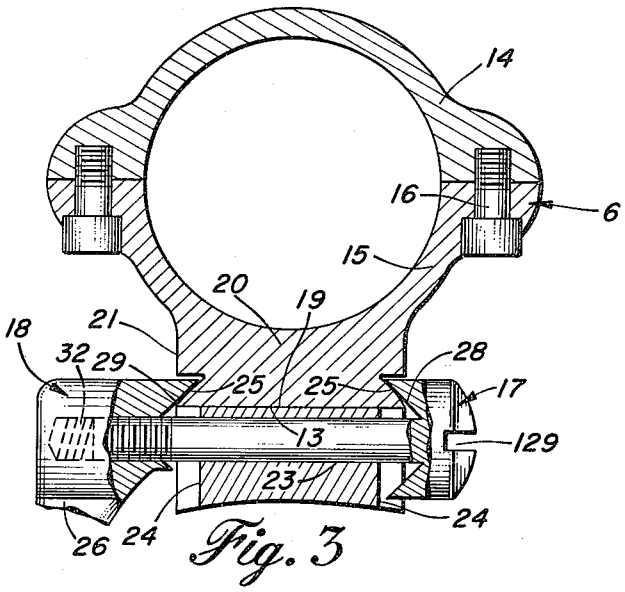
Fig. 3

QUICK DETACHABLE SCOPE MOUNT

BACKGROUND OF THE INVENTION

The invention relates to mounting systems for telescopic sights on guns such as sporting rifles.

BRIEF DESCRIPTION OF THE PRIOR ART

The following, inter alia, is intended to be a prior art statement in accord with the guidance and requirements of 37 CFR 1.5, 1.97, and 1.98.

The mounting of telescopic sights, that is, scopes, on guns of various kinds, in particular on rifles for sporting purposes, is an art that has seen various improvements over a considerable number of years.

A limited pre-examination search has been made. Comments on prior art found in the pre-examination search follow. However, it is to be understood that this search is not represented to be exhaustive, and other prior art may exist of which the inventor is not aware.

Some references which are deemed to be representative of the state of the art include the following: U.S. Pat. No. 1,926,151, U.S. Pat. No. 1,856,549, U.S. Pat. No. 2,919,097, U.S. Pat. No. 2,583,260, U.S. Pat. No. 3,029,516, U.S. Pat. No. 3,405,448, U.S. Pat. No. 3,424,420, and German Auslegeschrift No. 1,008,615. Patents which appear to be somewhat more nearly related to the instant invention, but which are still deemed to be principally representative of the state of the art include U.S. Pat. No. 3,880,389, U.S. Pat. No. 3,785,603, U.S. Pat. No. 2,306,972, and U.S. Pat. No. 2,486,002.

A series of three patents issued to Redfield, namely U.S. Pat. No. 1,816,195, U.S. Pat. No. 1,837,290, and U.S. Pat. No. 2,187,054, principally the latest Redfield patent, disclose the basis of a scope system that is widely employed and marketed. A well known line of scope systems produced by Redfield is a commercial example of this system; other manufacturers include: Leupold and Stevens, Inc., Maynard P. Bueler, Inc., and Browning Arms. Of course, the noted Redfield patents have long since expired.

These scope systems all employ a front swiveling mount which allows the scope to swing away from the gun and a rear locking mount which locks the scope in place when in use. The improvement in scope mounts disclosed and claimed herein is applicable to scope mounting systems of this type as exemplified by these commercial embodiments.

An objective which has been sought for many years is a scope which is readily demountable, but yet is exactly zeroed when reattached to the gun after demounting. Another objective is to have a scope which is quick detachable, that is, detachable in five seconds or less. This is particularly important with sporting rifles employed to hunt large and dangerous game. If the scope should somehow become inoperable, it is very advantageous to have a system whereby the scope may be quickly removed so that auxillary iron sights can be employed.

It is felt that U.S. Pat. No. 2,187,054 and British Pat. No. 266,848 are probably the closest references known of by the inventor. Thus, U.S. Pat. No. 2,187,054 discloses a screw 23 (FIG. 5) having a concave undersurface on its head which is employed to lock the rear scope mount in place by urging into convex recess 27 (FIG. 2). This system does serve to urge the scope into place directly against the flat mount surface quite well.

It is also more or less effective in zeroing the scope laterally. However, the screws do not have a truncated upper surface, and thus, the scope lacks quick detachable capability. Furthermore, the screws are inserted from both sides and varying tensions can be applied, thus resulting in minute variations from true lateral zero.

British Pat. No. 266,848 discloses, in FIG. 1 and in FIG. 7*a*, The fastener of the instant invention has a stop which automatically aligns with the bottom surface of the convex surface section of the rear scope mount. With the system disclosed by the British patent, one must visually align the screw. The screw in the British patent does not hold the scope ring down on the rifle, i.e., it has a flat screw head surface, and not a concave inner surface which cams the scope down against the base. In the British patent, the scope is held on via a radially cut dovetail. The screws simply provide right-left adjustment. The latching means, according to the invention, have concave inner surfaces which hold the scope down upon the rifle receiver mount.

The improvement claimed herein is submitted to be unobvious in view of the above cited disclosures.

OBJECTS OF THE INVENTION

An object of the invention is to provide an improvement associated with telescopic sight mount systems on guns in order to provide exact zeroing of the scope and quick detachable capability. A method for installing the improvement is also provided.

SUMMARY OF THE INVENTION

In a detachable scope mount for a gun comprising a base having an outer rear flat surface and fixable to the receiver of a gun, the flat surface being located on a plane parallel to the axis of the bore of the gun and perpendicular to a line radial to the axis of the bore of the gun; a front mount rigidly fixed to the front portion of the scope and attachable to the base in a manner such that movement of the scope only in a plane parallel to the flat surface is possible; a rear mount rigidly fixed to the rear portion of the scope and having a flattened surface contacting and parallel to the rear flat surface of the base when the front portion of the scope is mounted on the base and having two outward facing opposing convexoid surfaces; such that when the rear mount is positioned so that the scope is aligned with a plane passing outward from the axis of the gun bore and at a 90° angle to the plane of the flattened surface, a bore passes through the base parallel to the flattened surface and perpendicular to the bore of the gun and parallel to the axis of the convexoid surfaces; wherein a first latching means having a shaft member of size such as to be snugly turnable and insertable in the bore in the base and having a head member having an inner concavoid surface matable with one of the convexoid surfaces, and wherein the first latching means is positioned with its shaft member in the bore in the base; an improvement is provided comprising a quick detachable and remountable apparatus comprising:

(a) the shaft member of the first latching member being fixed in the bore in the base;

(b) a second latching means having a head member and threads matable with threads centering on the bore in the base and an inner concavoid surface matable with the other convexoid surface of the rear mount;

such that when the second latching means is screwed on or in the threads centering on the bore in the base, the scope is fixedly centered; the improvement further characterized in that the head of the second latching means is sufficiently truncated along a plane parallel to the bore through the base such that the rear mount will pass over the truncation when the second latching means is unscrewed in the unlatched position such that the truncation is parallel to the flattened surface of the base.

BRIEF DESCRIPTION OF THE DRAWINGS

FIG. 1 is an overall view of the scope mount showing a first embodiment of the inventive improvement in place.

FIG. 2 is a similar view with the scope removed showing the base(s) with the inventive improvement in place, in the unlatched position as opposed to the latched position in FIG. 1.

FIG. 3 shows a cross section along plane 3—3 shown in FIG. 1. The rear scope mount is shown fastened to the base by a first embodiment of the inventive latching apparatus.

FIG. 4 shows a perspective of the rear scope mount.

DESCRIPTION OF THE DRAWINGS

Figure 7:
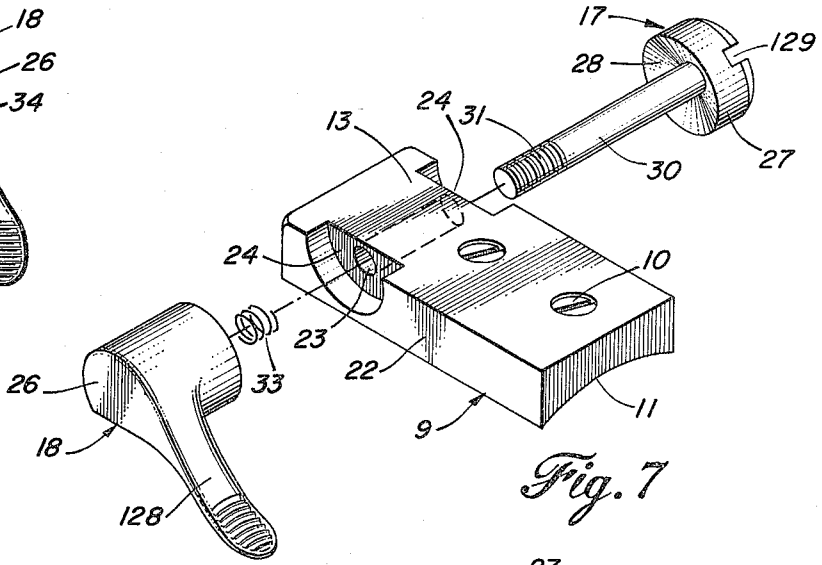
FIG. 7 shows the left and right latching members of the first embodiment disassembled from the rear base.

FIG. 1 shows a perspective of the improvement of the invention incorporated with a suitable scope mounting system according to a first embodiment.

Thus, scope 1 having windage and elevation controls 2 and 3, and shown with cut aways 4 and 5 to better illustrate detail, is held by rear mount 6 and front mount 7. Front mount 7 is swivel mounted such as to permit horizontal rotation on front base section 8. Rear mount 6 is held in place on rear base section 9 according to the improvement of the invention. Both front base section 8 and rear base section 9 have bottom surfaces 11 such as to smoothly fit on a rifle receiver. Rear view section 12 is shown on the scope. The base sections are secured to the receiver of the rifle (not shown) as by screws 10 which are recessed below flat upper surface 13 of the rear base section. The mounts are generally comprised of an upper section 14 and a lower section 15 tensioned together by a screw 16 (shown in FIG. 3), and of a proper size to hold the scope in snug alignment. The above cited features are all part of the prior art, and the embodiment shown in the figures is that of a commercially available Redfield scope mount.

The same numbers are used to refer to the same items in all figures.

FIG. 2 semi-schematically shows how the scope is swung through angle 117 upon unlatching for quick detachment. Once an angle greater than 117 is obtained, the scope can be simply lifted upward from the front base section 8 having retaining slot 118. This mechanism for the front mount is well known to the art and is exemplified by the presently commercially available Redfield system.

With background as provided by the above description the first embodiment of the improvement invention is shown in combination with the commercially available "Redfield" system as is shown in FIGS. 1 through 9, as appropriate, in accord with the following.

The inventive improvement of the first embodiment is particularly associated with right latching means 17 and left latching means 18 acting in combination with the rear scope mount. The overall position of these elements is shown in FIGS. 1 and 2. Detail of how the elements function in combination with the scope mount is particularly shown in FIGS. 3 and 4, and detail of the elements themselves is particularly shown in FIGS. 5, 6, and 7. The mechanism is shown in the latched position in FIGS. 1, 3, 7, and 9. It is shown in the open or unlatched position in FIGS. 2 and 8. In the latched position the scope is held absolutely zeroed in place both as to lateral and as to vertical deviation. In the open or unlatched position the scope can swing to the side as shown in FIG. 2 for easy detachment.

Further details of this first embodiment are described in accordance with the following.

Rear scope mount 6 has a bottom base member 20 having a flat bottom base surface 19 which is smoothly fitable upon upper surface 13 of rear base section 9 such as to permit precise side to side movement upon attaching and detaching the scope. When the scope is in the mounted position and zeroed, the left side 21 of the rear scope mount and the left side 22 of the rear base section are in a near vertical alignment. In like manner, the right sides are also in or near vertical alignment.

A transverse bore 23 through the rear base section is best shown in FIG. 3 illustrating a cross section taken along plane 3—3 shown in FIG. 1. Symmetrical around bore 23 are truncated recesses 24 milled into both sides of the rear base section 9.

Convex surfaces 25, matable with concave surface 29 milled into head 26 of left latching member 18 and concave surface 28 milled into head 27 of right latching member 17, are milled into the side of rear scope mount 6.

Left latching member 18 has lever 128 for easy movement and right latching member 17 has slot 129 in its head 27. Right latching member 17 also has a shaft 30 having male threads 31 on its end matable within female threads 32 cut in latching means 18. A spring 33 tensions the latching members apart until the scope is locked in zero alignment.

One side of head 26 of left latching member 18 is truncated along plane 34 such that plane 34 forms an extension of upper surface 13 of rear base section 9 when the left latching member 18 is in place in the unlatched position.

Stop 35 on left latching member 18 abuts, upon unlatching, up against the lower flattened base surface 19. This provides proper positioning of left latching member 18 for detaching the scope by feel alone (best visualized in FIG. 8).

A second mode or embodiment of the invention is illustrated in FIGS. 10, 10*a*, 11, and 12. This mode is presently preferred.

Thus referring to FIG. 12, and FIGS. 10, 10*a*, and 11 as appropriate, stud 171 has male threads 139 which are matable with female threads 138 in traverse bore 23. Stud 171 also has stop 236 and male threads 131 which are matable with female threads 32 of latching means 18.

Latching member 217, part of the prior art, has male threads 231 which are matable with female threads 138 from the right in traverse bore 23, slot 299 for a screw driver in its head 227, and concave surface 228 milled into its head 227.

Figure 12:
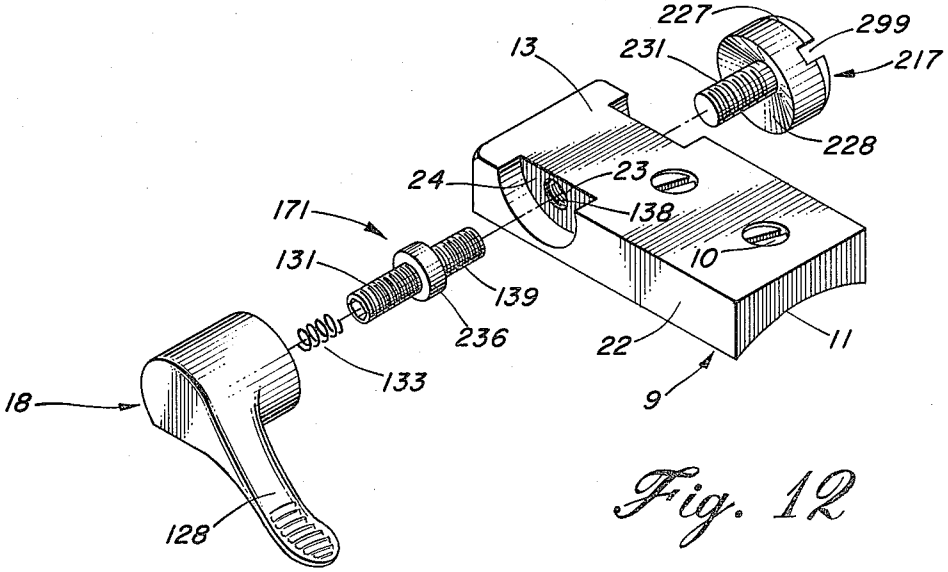
FIG. 12 shows the left and right latching members of the second embodiment in a partially disassembled mode.
Figure 11:
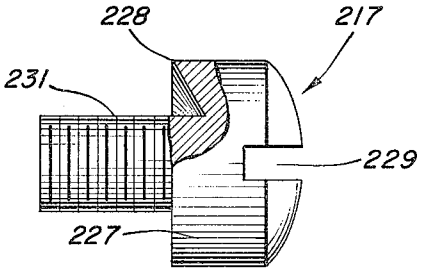
FIG. 11 shows the right latching member of the second embodiment.
Figure 10:
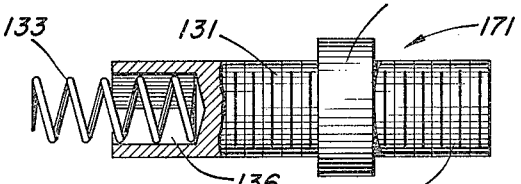
FIG. 10 shows the screw in stud of the second embodiment.
Figure 10A:
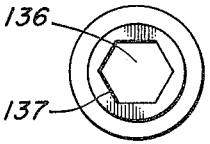
FIG. 10*a* shows an end view of the screw in stud of FIG. 10, as viewed from left to right.

As particularly shown in FIG. 12, latching member 217 is screwed into the right of traverse bore 23 of rear base section 9. Threads 139 of stud 171 are threaded into female threads 138 from the left of traverse bore 23 such that stop 236 stops further threading. The stud is screwed into place by means of an allen wrench which fits into hex receptacle 136 having flats 137 in the left member of the stud. Once the stud is screwed into place a spring 133 is employed to tension left latching member 18. Other items and features in FIG. 12 are numbered and have the same function as shown in FIG. 7.

PREFERRED EMBODIMENTS OF THE INVENTION

The drawings and description thereof, as well as the following exemplification and description relating to preferred modes are provided to more fully explain the invention and to provide information to those skilled in the art on how to carry it out. However, it is to be understood that such is not to function as limitation on the invention as described and claimed in the entirety of this application.

According to a preferred mode, and referring to drawings, 1 through 9, a transverse bore 23 is shown through the rear base section 9. Convex surfaces 25 are present in both sides of rear scope mount 6, as shown.

Thereupon, left latching member 18 having concave surface 29, female threads 32, lever 128, and stop 35 is fabricated as shown to have the spatial relationship shown to right latching member 17, base surface 19, and rear mount 6. Fabrication can be by any conventional means. High grade steel is a preferred material for fabrication, though other metals and material can be employed if they have adequate strength and structural integrity. It is truncated along surface 34 as shown.

Right latching member 17 having concave surface 28, shaft 30, male threads 31 and slot 129 is fabricated by conventional means as shown. It has the spatial relationship shown in the drawings to left latching member 18, base surface 19, and rear mount 6. Materials such as those employed for the left latching member 18 can be employed for fabrication by conventional means.

A spring 33 or other means to urge left latching member 18 away from base section 9 and prevent "flop" is also provided.

Figure 9:
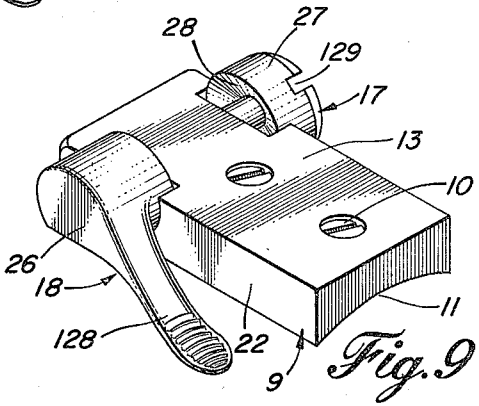
FIG. 9 shows the latching members in place, but in a latched position.
Figure 5:
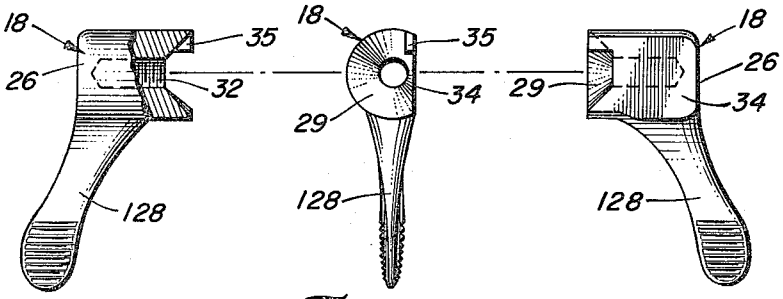
FIG. 5 shows three views of the left latching member in various perspectives.
Figure 6:
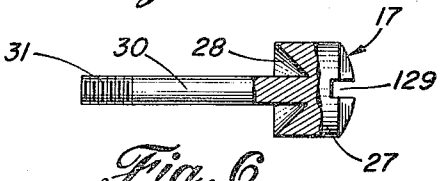
FIG. 6 shows the right latching member of the first embodiment in partial cross section.
Figure 8:
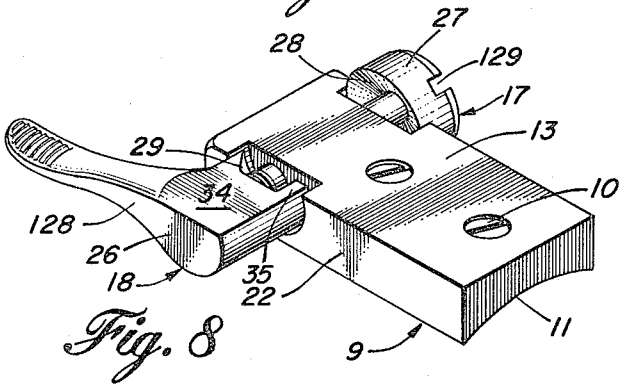
FIG. 8 shows the latching member assembled onto the base and in the open position.

To install and zero the scope, right latching member 17 is inserted into the right of bore 23 as shown in FIG. 7 after having a high strength adhesive material such as a curable epoxy resin applied appropriately. Spring 33 is emplaced over the end of shaft 30 when it emerges. Left latching member 18 is then put in place as shown in FIG. 8, and the latching members are partially screwed together. The scope is mounted as shown in FIG. 1. The left latching member is positioned in the latch position as shown in FIGS. 1 or 9. Righ latching 17 is then further tightened into left latching member 18 while laterally zeroing the scope with the gun by means of tapping to left or right. Final adjustments of lateral zero and tension are made to obtain the positions shown according to FIG. 3. Surface 19 is camed against surface 13 by tensioning of surfaces 28 and 29 against surface 25, and is centered in a very precise manner. Upon setting up of the adhesive, shaft 30 is locked in place in bore 23. Thereupon, the scope can be dismounted and remounted to precise zero as previously described. Quick detach and remount capability is present.

The presently preferred embodiment of the invention is shown in FIGS. 10, 10*a*, 11, and 12 particularly, in view of the other figures as appropriate. The right latching member 217 and rear base section 9 having traverse bore 23 and female threads 138 are part of the prior art, and are for example part of the commercially available Redfield mount systems.

According to this presently preferred embodiment of the invention a kit comprising stud 171, spring 133, and left latching member 18 is provided. The left latching member of the Redfield system is discarded. The right latching member of the Redfield system 217 is retained.

An adhesive such as a cyanoacrylate polymer or epoxy resin with a curing agent is applied to threads 139 of stud 171 and the threads are screwed into the left threads 138 of traverse bore 23 until stop 236 abuts by means of an allen wrench employed in hex receptacle 136. The adhesive is applied to threads 231 of the right latching member 217, and it is screwed into position in the right side of traverse bore 23 by means of slot 229.

Thereupon spring 133 is placed in hex receptacle 136 and left latching member 18 is screwed on threads 131 of stud 171 such that its female threads 32 mate upon male threads 131.

The left latching member is positioned as shown in FIG. 8, the scope is attached and the right latching means is adjusted such that proper zeroing of the scope is obtained. The adhesive is allowed to set, and the conversion installation is complete.

The base is shown as front base section 8 and rear base section 9. However, it is apparent that the base can be a single integral unit.

In accord with yet a third embodiment of the invention, the right latching member 217, rear base section 9 having traverse bore 23 and female thread 138 are part of the prior art as shown in FIGS. 10, 10*a*, 11, and 12. However in accord with this third embodiment, not particularly shown by the drawings, the left latching member has male threads matable with female threads 138 on a shaft member rather than the female threads of the presently preferred embodiment shown in FIGS. 10, 11, and 12, in particular.

I claim:

1. In a detachable scope mount for a gun comprising a base having an outer rear flat surface and fixable to the receiver of the gun, the flat surface being located on a plane parallel to the axis of the bore of the gun and perpendicular to a line radial to the axis of the base of the gun; a front mount rigidly fixed to the front portion of the scope and attached to the base in a manner such that movement of the scope only in a plane parallel to the flat surface is possible; a rear mount rigidly fixed to the rear portion of the scope and having a flattened surface contacting and parallel to the rear flat surface of the base when the front portion of the scope is mounted on the base and having two outward facing opposing convexoid surfaces; such that when the rear mount is positioned so that the scope is aligned with a plane passing outward from the axis of the gun bore and at a 90° angle to the plane of the flattened surface, a bore passes through the base parallel to the flattened surface and perpendicular to the bore of the gun and parallel to the axis of the convexoid surfaces; wherein a first latching means having a shaft member of size such as to be snugly turnable and insertable in the bore in the base and having a head member having an inner concavoid surface matable with one of the convexoid surfaces, and wherein the first latching means is positioned with its shaft member in the bore in the base;

the improvement comprising:

(a) the shaft member of the first latching means being adjusted and fixed in the bore in the base;

(b) a second latching means having a head member and threads matable with threads centering on the axis of the bore in the base and an inner concavoid surface matable with the other convexoid surface of the rear mount;

such that when the second latching means is screwed on or in the threads centering on the axis of the bore in the base, the scope is fixedly centered; the improvement further characterized in that the head of the second latching means is sufficiently truncated along a plane parallel to the bore through the base such that the rear mount will pass over the truncation when the second latching means is unscrewed in the unlatched position such that the truncation is parallel to the flattened surface of the base.

2. In a detachable scope mount for a gun comprising: a base having an outer rear flat surface and fixable to the receiver of the gun, the flat surface being located along a plane parallel to the axis of the bore of the gun; a front mount rigidly fixed to the front portion of the scope and attachable to the base in a manner such that movement of the scope only in the plane parallel to the axis of the gun bore is possible; a rear mount rigidly fixed to the rear portion of the scope and having a flattened surface contacting and parallel to the rear flat surface of the base when the front portion of the scope is mounted on the base and having two outward facing opposing convexoid surfaces; such that when the rear mount is positioned so that the scope is aligned with a plane passing outward from the axis of the gun bore and at a 90° angle to the plane of the flattened surface, a bore passes through the base parallel to the flattened surface and perpendicular to the bore of the gun and parallel to the facing axis of the convexoid surfaces; wherein a first latching means having a shaft member of size such as to be snugly turnable and insertable in the bore in the base and having a head member having an inner concavoid surface matable with one of the convexoid surfaces, and wherein the first latching means is positioned with its shaft member fixed in the bore in the base;

the improvement comprising:

(a) a stud means fixable in the bore in the base and having a shaft member projecting from the bore in the base and having male threads on its end;

(b) a second latching means having a head member and female threads matable with the male threads of the shaft member of the stud means and an inner concavoid surface matable with the other convexoid surface of the rear mount;

such that when the second latching means is screwed on the shaft member of the stud means, the scope is fixedly centered;

the improvement further characterized in that the head of the second latching means is sufficiently truncated along a plane parallel to the bore through the base such that the rear mount will pass over the truncation when the left latching means is unscrewed in the unlatched position such that the truncation is parallel to the flattened surface of the base.

3. The improvement of claim 2 wherein the second latching means has a lever means extending out in a plane perpendicular to the bore through the base and positioned such that the lever clears the scope and rear mount when the second latching means is in the open position and the scope is detached.

4. The improvement of claim 2 wherein the second latching means has a stop means which abuts up under the flattened surface of the rear mount parallel to the rear flat surface of the base and upon unlatching the second latching means such as to provide proper positioning of the second latching means for detachment of the scope by feel alone.

5. The improvement of claim 4 wherein the second latching means has a lever means extending out in a plane perpendicular to the bore through the base and positioned such that the lever clears the scope and rear mount when the second latching means in is the open position and the scope is detached.

6. The improvement of claim 5 wherein the base comprises a front base section and a rear base section.

7. The improvement of claim 5 wherein the stud means comprises an extension of and is integral with the shaft member of the first latching means.

8. The improvement of claim 5 wherein the bore passing through the base is internally threaded, wherein the shaft member of the first latching means is threaded to be matable with the internal threads, wherein the shaft member of the first latching means extends only partially through the threaded bore when positioned in place, wherein the stud means is separate from the first latching means and is threaded so as to be matable in the internally threaded bore and is of suitable length for the second latching means to be screwed in position when the stud is in place.

9. The improvement of claim 8 wherein the stud means has a bore along the center of its long axis, and wherein the bore is sized to permit positioning a spring therein for urging out and steadying the second latching means when in position.

10. The improvement of claim 9 wherein stud means has flats on the internal surface of the bore along its center axis suitable for turning the stud in place in the threaded bore.

11. The improvement of claim 10 wherein the base comprises a front base section and a rear base section and wherein the first latching means has a tool engaging means for adjustment into position.

* * * * *